US007051879B2

(12) United States Patent
Ramet

(10) Patent No.: US 7,051,879 B2
(45) Date of Patent: May 30, 2006

(54) TUBE FOR PACKAGING A PRODUCT AND A SAMPLE ASSOCIATED WITH THE PRODUCT

(75) Inventor: Marc Ramet, Asnieres (FR)

(73) Assignee: L'Oreal, Paris (FR)

( * ) Notice: Subject to any disclaimer, the term of this patent is extended or adjusted under 35 U.S.C. 154(b) by 143 days.

(21) Appl. No.: 10/419,879

(22) Filed: Apr. 22, 2003

(65) Prior Publication Data

US 2004/0011678 A1 Jan. 22, 2004

Related U.S. Application Data

(60) Provisional application No. 60/381,331, filed on May 20, 2002.

(30) Foreign Application Priority Data

Apr. 22, 2002 (FR) ..... 02 05002

(51) Int. Cl.
*B65D 77/00* (2006.01)

(52) U.S. Cl. ..... 206/730; 206/216; 206/581; 206/823

(58) Field of Classification Search ..... 132/286; 206/63.5, 219, 221, 222, 229, 277, 568, 581, 206/216, 730; 222/93, 94; 383/37; 604/409, 604/410

See application file for complete search history.

(56) References Cited

U.S. PATENT DOCUMENTS 1,867,494 A * 7/1932 Buchner ..... 510/148
1,968,298 A * 7/1934 Klein ..... 222/92
3,189,227 A * 6/1965 Hobbs et al. ..... 222/94
3,534,887 A * 10/1970 Ginsberg ..... 222/107
3,608,709 A * 9/1971 Pike ..... 206/219
4,138,014 A * 2/1979 Bouman ..... 206/542
4,458,811 A * 7/1984 Wilkinson ..... 206/219
4,637,061 A * 1/1987 Riese ..... 383/38

FOREIGN PATENT DOCUMENTS

| | | |
|---|---|---|
| CH | 585647 | 3/1977 |
| DE | 2111701 | 9/1972 |
| GB | 1081586 | 8/1967 |

* cited by examiner

*Primary Examiner*—David T. Fidel
*Assistant Examiner*—Jerrold Johnson
(74) *Attorney, Agent, or Firm*—Oblon, Spivak, McClelland, Maier & Neustadt, P.C.

(57) ABSTRACT

A packaging arrangement for a product and a sample associated with the product. The packaging includes a flexible tube having a first end which delimits an outlet hole a second end opposite the first which is closed at an end closure zone formed by fastening an end edge portion of the tube onto itself, for example, by welding or adhesive bonding. The tube further includes at least one intermediate closure zone which is formed between the first and second ends, and which is formed by fastening a wall of the tube onto itself along at least one transverse line so as to define at least two compartments which are isolated from one another. One of the compartments communicates with the outlet hole. The two compartments can be separated from one other by breaking (e.g., tearing) an arrangement for facilitating separation, with the separation facilitating arrangement provided in the region of the intermediate closure zone. The product and the sample can be the same or different products.

40 Claims, 5 Drawing Sheets

TUBE FOR PACKAGING A PRODUCT AND A SAMPLE ASSOCIATED WITH THE PRODUCT

CROSS REFERENCE TO RELATED APPLICATIONS

This document claims priority to French application number 02 05002 filed Apr. 22, 2002 and U.S. Provisional application No. 60/381,331, filed May 20, 2002, the entire content of which is hereby incorporated by reference.

FIELD OF THE INVENTION

The present invention relates to a tube for packaging a product and a sample associated with the product. The invention is particularly suitable for packaging cosmetic products, such as hair products including, for example, products for styling, washing, conditioning or dying hair. The invention can also be advantageously used for other products including, for example, hygiene products, skincare or sunscreen products.

BACKGROUND OF THE INVENTION

DISCUSSION OF BACKGROUND

U.S. Pat. No. 2002/0029985 discloses a tube which has two chambers for packaging two products separately, and for subsequently being able to mix these products by establishing communication between the two chambers.

Especially in the field of cosmetics, it is common to distribute samples in conjunction with the sale of one or more products. This distribution allows the consumer to learn about products other than that or those which she (or he) is purchasing, often with a view toward encouraging the future purchase of the sampled product.

Problems associated with packaging of samples include their cost, which needs to be as low as possible, and the manner in which the samples are presented with a product being purchased. Regarding the latter point, the sample could be handed out by the cashier at the time of payment for the product being purchased. However, this method of presentation is not very suitable for large-scale retailing, where it is desirable for the product being purchased to be presented directly with the sample product without substantially altering the cost or the presentation of the product being purchased.

Tubes, which can be presented without any other form of outer packaging, are problematic in this respect. One solution could include adhesively bonding the sample onto the tube, or fastening it thereon by some other means. However, aesthetically, this solution can be undesirable. This approach can also be disadvantageous in terms of cost, since it adds another packaging operation. Moreover, this adhesive attachment approach can be difficult to automate, and there is substantial risk that the sample will become separated from the product during handling or transport.

SUMMARY OF THE INVENTION

It is therefore an object of the invention to provide a tube for packaging a product, and a sample associated with the product, which solves all or some of the problems discussed above.

It is a further object of the invention to provide a packaging arrangement which is economical to manufacture and in which the presentation of the sample, in relation to the product with which it is associated, is improved as compared with conventional methods of presentation.

Other objects and advantages will become apparent from the detailed description herein.

According to the invention, the above objects are achieved by providing a flexible tube having a first end which delimits an outlet hole. Preferably, the tube includes an axis X. A second end opposite the first is closed over an end closure zone obtained by fastening an end edge of the tube onto itself, for example, by welding or adhesive bonding. The tube further includes at least one intermediate closure zone which is formed between the first and second ends, at a non-zero distance from the ends. The intermediate closure zone is obtained by fastening a wall of the tube onto itself along at least one line transverse to the axis X, so as to define at least two compartments which are isolated from one another. The two compartments include a first compartment, which communicates with the outlet hole and which contains a first product or product portion, and a second compartment, which is formed between the closure zones and which contains a second product or second product portion. The second product can be the same as or different from the first product.

With the arrangement of the invention, two compartments are delimited by the same tube body, with one of the compartments containing a product and the other containing a sample of a product, which is the same as or different from the product contained in the first compartment. Accordingly, it is not necessary to fasten two separate packages or containers together. The risk that the sample will become detached from the package, especially during transport, is thereby substantially reduced as compared with conventional systems discussed above.

The intermediate closure zone includes an arrangement, for example, in the form of a weakened line or a pre-cut line, for facilitating separation of the two compartments. Advantageously, the arrangement breaks upon application of a manual force, for example, by pulling on each of the two compartments. The pulling is, for example, exerted by holding one of the compartments in one hand and the other compartment in the other hand, and separating the compartments by moving the hands apart.

The intermediate closure zone is preferably straight and substantially perpendicular to the axis of the tube. This is not an absolute requirement, however, and the zone can be, for example, curved, inclined relative to the axis, or extend along a zig zag or other pattern.

Advantageously, at least one of the closure zones can have a non-straight edge, so as to make it possible to delimit a localized outlet passage for the product contained in the second compartment when opening the second compartment. By cutting the closure zone which has the non-straight edge with a straight cut (to cross the non-straight edge at least at two points) an opening is thereby formed between the two points at the outlet passage. Preferably, the non-straight edge is formed by the intermediate closure zone and delimits a protuberance, which is in communication with the second compartment. A narrow passage, which is preferably centered on the longitudinal axis of the tube, can thereby be defined by cutting as described above, so as to allow localized dispensing of the product.

An arrangement in the form, for example, of a preparatory cut or tear, or a weakened or pre-cut line, could also or alternatively be provided to assist manual opening of the second compartment. Such an arrangement may be provided either level with the end closure zone or level with the intermediate closure zone. If such an arrangement is not already provided for assisting opening of the second compartment, opening may again be carried out simply by cutting with a pair of scissors.

Preferably, the tube includes a tubular body obtained or formed by extruding a layer of at least one thermoplastic material, such as a high or low density polyethylene, or a polypropylene, or by calendering or co-extruding a complex with a plurality of layers with the layers preferably including at least one thermoplastic material.

By way of example, the end closure zone and the intermediate closure zone can be formed by adhesive bonding or welding (e.g., welding with heat or ultrasonic welding).

The external surface of the body can be varnished to improve its appearance. When a varnished surface is used, the varnish can optionally be excluded in the regions corresponding to the closure or sealed zones.

The outlet hole of the tube can be delimited by a head which is added on to the body of the tube. The head can be coupled or fastened to the tube, for example, by welding or adhesive bonding. The head is preferably obtained by injection molding.

Advantageously, the first end of the tube is preferably equipped with a dispensing cap having a dispensing hole for dispensing the product, with the hole of the cap in at least selective communication with the outlet hole. The dispensing cap preferably also includes a closure element for reversibly sealing the said dispensing hole. In accordance with an exemplary embodiment, the dispensing cap can include a body which is fitted firmly onto the tube, e.g., by snap-fastening or by screwing. The dispensing cap delimits the dispensing hole, with a closure element or cap articulated onto the body, e.g., via a hinge such as a film hinge or a spring-effect or spring biasing hinge. The closure element can also be screwed or snap-fastened onto the body of the cap.

In accordance with another aspect, the invention provides a method for packaging a product, and a sample product associated with the product inside a flexible tube, preferably a tube having an axis X. The method includes introducing the product through an open end of the tube, which is opposite a closed end, and filling the product up to a filling level located at a non-zero distance from the open end. In addition, an intermediate closure zone is formed above the filling level, at a non-zero distance from the open end, by fastening a side wall of the tube onto itself along at least one line transverse to the axis X, so as to seal a first compartment formed on a first side of the intermediate closure zone. The sample product is introduced above the intermediate closure zone through the open end and an end closure zone is formed by fastening an end edge of the tube onto itself so as to form, on the opposite side of the intermediate closure zone from the first compartment, a second compartment containing the sample product so that it is isolated from the product contained in the first compartment. An arrangement or region is also preferably provided for facilitating subsequent separation of the two compartments, e.g., in the form of a weakened line and/or a pre-cut portion.

An alternative process can also be used, for example, when the same product is being packaged in both compartments. With this process, the product is introduced into the tube through an open end of the tube, which is opposite a closed end. An end closure zone is formed by fastening an end edge of the tube onto itself, and an intermediate closure zone formed at a non-zero distance from the end closure zone, by fastening a side wall of the tube onto itself along at least one line transverse to the axis X so as to form a first compartment containing a first part or portion of the product on one side of the intermediate closure zone, and a second compartment, which is isolated from the first and which contains a second part or portion of the product on the other side of the intermediate closure zone. With this method, the product in the two compartments can be introduced in the same filling step. As in the previously discussed method, an arrangement or region can be provided for facilitating subsequent separation of the two compartments, e.g., with a weakened line and/or a pre-cut portion.

A configuration in which the sample product is the same as the product may be useful, in particular, for "traveling" use of the second compartment. For example, for weekend travel, the user can take just the sample with him or her in order to reduce the encumbrance in a toilet bag or other luggage.

The product and the sample product can be products for cosmetic use, especially products for hairdressing, body or hair hygiene, or other skincare or haircare products such as a sunscreen.

BRIEF DESCRIPTION OF THE DRAWINGS

The above and additional objects and advantages of the invention will become readily understood in view of the detailed description herein, particularly when considered in conjunction with the drawings in which.

DETAILED DESCRIPTION OF THE PREFERRED EMBODIMENTS

Figure 1C:
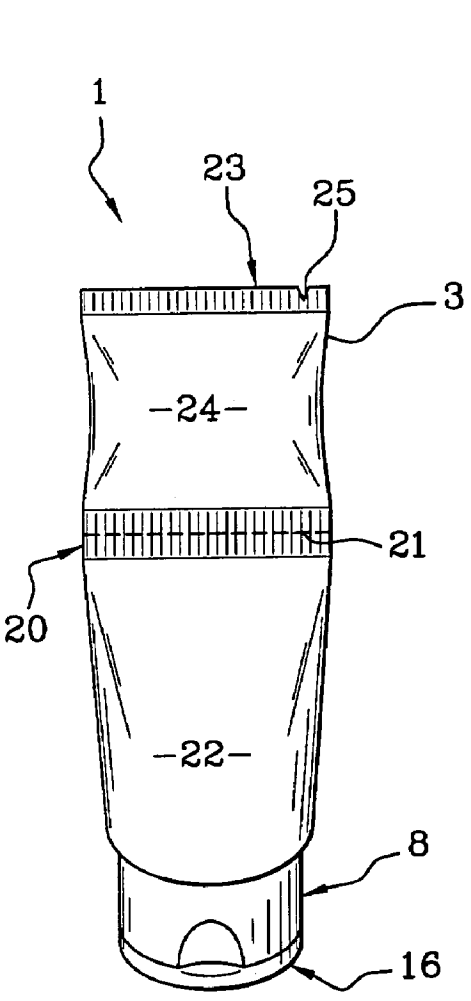
FIGS. 1A–1C illustrate the packaging of a product and a sample associated with the product, in a tube according to a first exemplary embodiment of the invention.
Figure 1B:
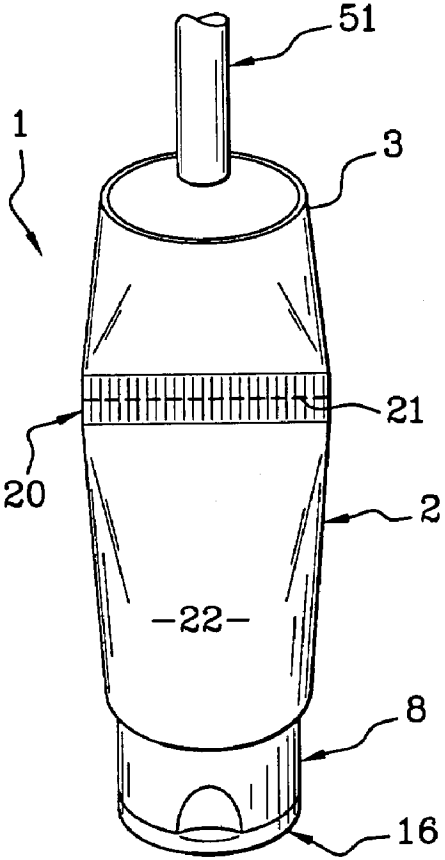
Figure 1A:
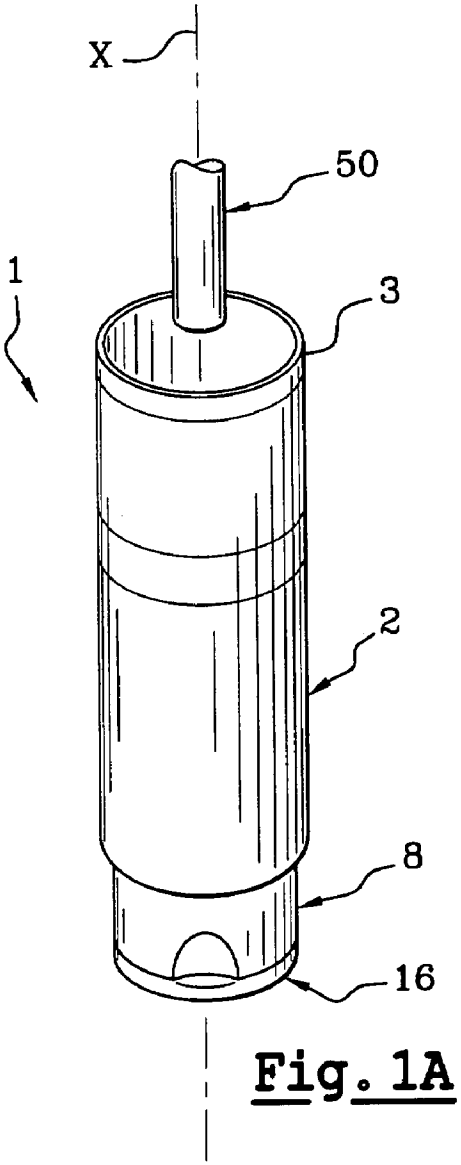
Figure 2:
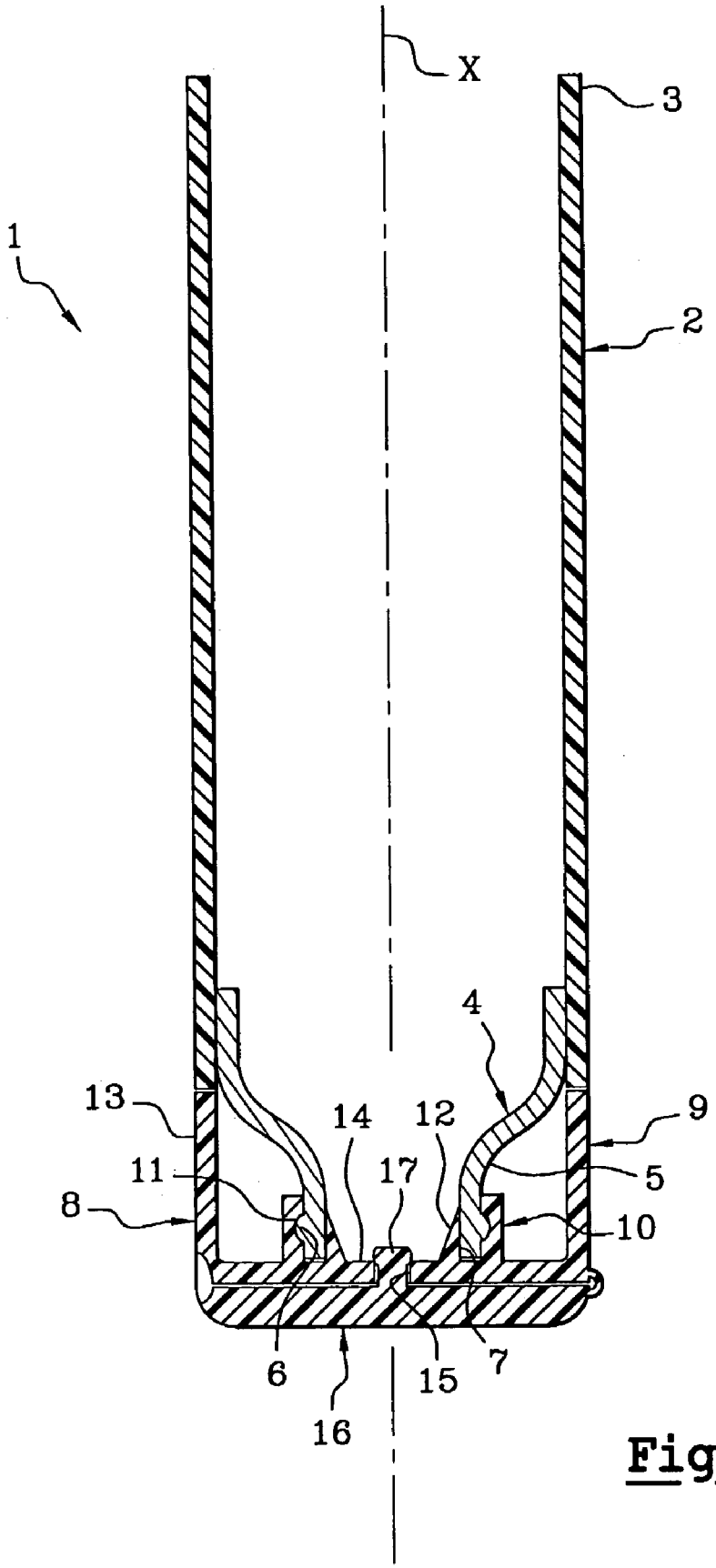
FIG. 2 is a cross-sectional view of the tube of FIG. 1A.

FIGS. 1A and 2 illustrate a tube prior to being filled. The tube includes a tubular body 2, one end 3 of which is open. The tubular body 2 can be formed, for example, by extruding a polypropylene. In the illustrated embodiment, a head 4 (e.g., formed by injection molding a polypropylene material) is fastened onto the other end such as by welding or another fastening expedient. The head forms a neck 5, the external surface of which includes a snap-fit bead 6 and a free edge of which delimits an opening 7 for the tube.

A cap 8 is fitted onto the head 4 of the tube 1, e.g., by snap-fastening. The cap includes a body 9 fitted firmly onto the tube head 4. For this purpose, the body 9 can include a first skirt 10, the internal surface of which includes a groove 11 which can interact with the bead 6 so as to fasten the cap onto the tube. The body 9 of the cap also preferably includes a second skirt 12, which is intended to provide a seal inside the neck of the tube. In addition, a third skirt 13 is also preferably provided primarily to function as a trim. A transverse wall 14 of the body 9 of the cap has a hole 15 at its center for dispensing the product. It is to be understood that different coupling/sealing arrangements could be provided at the end of the tube to allow the product to be selectively dispersed from the package.

In the illustrated embodiment, a "top" or cap 16 is articulated onto the body 9 of the cap. An internal surface of the cap includes a lug 17 which, in the closed position as represented in the sectional view of FIG. 2, seals the dispensing hole 15 in a leak tight fashion. The external surface of the top 16 is preferably substantially flat, so that the tube 1 can stand on the top in a stable manner.

FIGS. 1A–1C illustrate the steps of filling the tube according to a particular example of an embodiment of the invention. In FIG. 1A, the tube 1 is turned upside down. In this position, the cap 8 is in the closed position and the top 16 stands stably on a flat surface. The end 3 of the tube is open. A first product is introduced into the tube via its open end 3 by using a filling rod 50. By way of example, the first product is filled up to a level located substantially two-thirds of the way up the axial height of the tube, although other filling levels are also possible. After the filling step in FIG. 1A, a transverse weld or seal zone 20 is formed. In this embodiment, the weld or seal is preferably formed with ultrasound just above the filling level in FIG. 1A.

In the illustrated embodiment, a dashed pre-cut line 21 extends over the full width of the tube 1. The pre-cut line is preferably formed substantially in the middle of this weld zone 20. A first compartment 22 is thereby produced, a first end of which is closed by a weld zone 20 and a second end of which is equipped with the cap 8.

As can be seen in FIG. 1B, a filling rod 51 can be used to introduce a sample product. Preferably the sample is different from the first product, although the sample product could also be the same as the first product. As shown in FIG. 1B, the sample product is introduced via the open end 3 into the part of the tube 1 located above the closure zone 20 (which forms an intermediate closure zone). The sample product is introduced in the amount desired, preferably until substantially the maximum filling level of the tube 1 is achieved.

As in FIG. 1C, the end 3 of the tube can then be closed over a weld or seal zone 23. A second compartment 24, which is completely isolated from the first, is thereby delimited between the closure zones 20 and 23. Preferably, a notch or preparatory tear 25 is then made in the closure zone 23 to assist opening of the compartment 24.

Figure 3D:
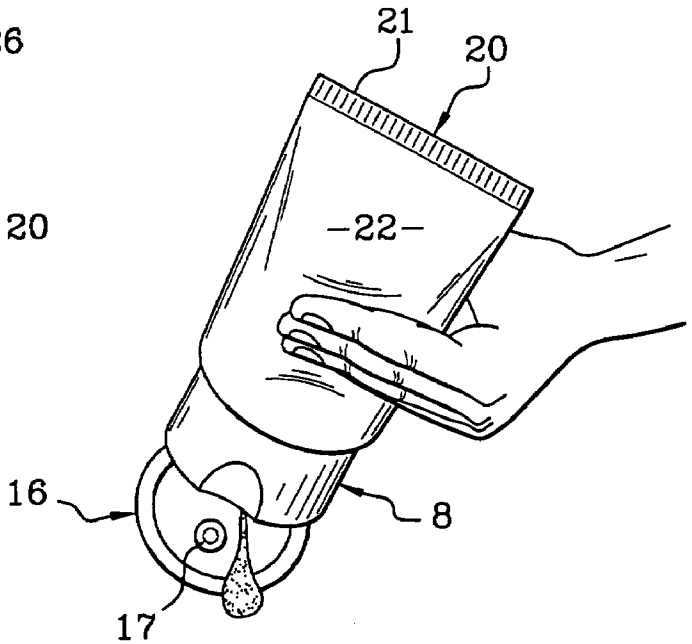
FIGS. 3A–3D illustrate the use of the tube represented in FIGS. 1A–1C and 2.
Figure 3B:
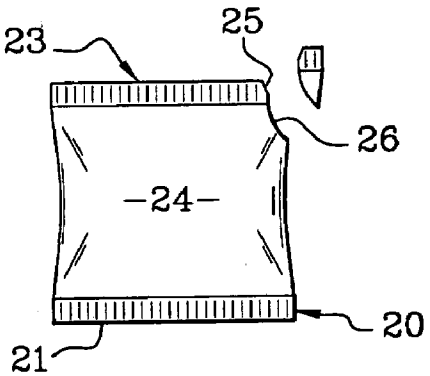
Figure 3C:
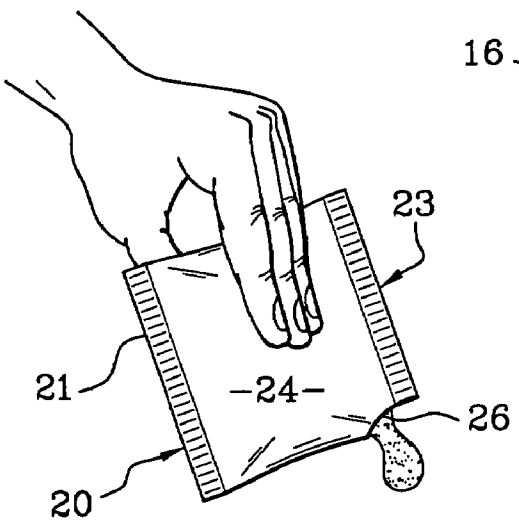
Figure 3A:
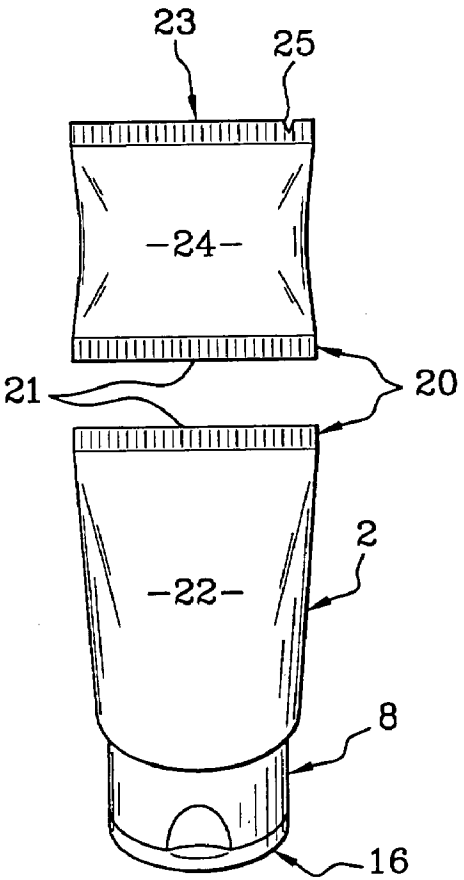

FIGS. 3A–3D illustrate, by way of example, a possible sequence for use of the tube discussed with reference to FIGS. 1A–1C and 2. As shown in FIG. 3A, the compartment 24 is separated from the compartment 22 along the pre-cut or weakened line 21. In FIG. 3B, the compartment 24 is opened at the preparatory tear 25. As shown in FIG. 3C, the sample product contained in the compartment 24 is then dispensed via the opening 26 obtained by breaking the preparatory tear 25. As shown in FIG. 3D, the content of the compartment 22 can be dispensed in the same way that a product contained in a conventional tube is dispensed. Typically, the top 16 is opened and the product emerges via the hole 15 of the cap 8 in response to pressure exerted on the deformable walls of the tube.

Figure 4C:
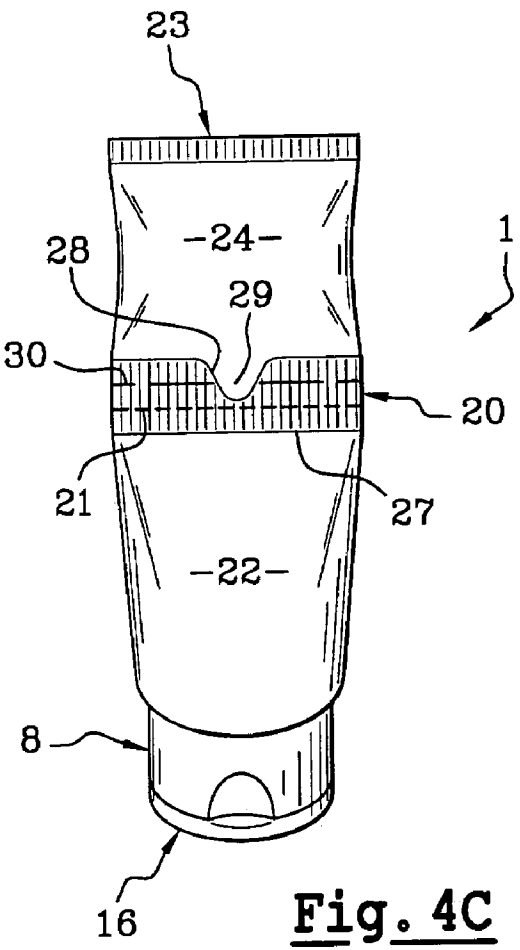
FIGS. 4A–4C illustrate the packaging of a product and a sample associated with the product, in a tube according to a second exemplary embodiment of the invention.
Figure 4B:
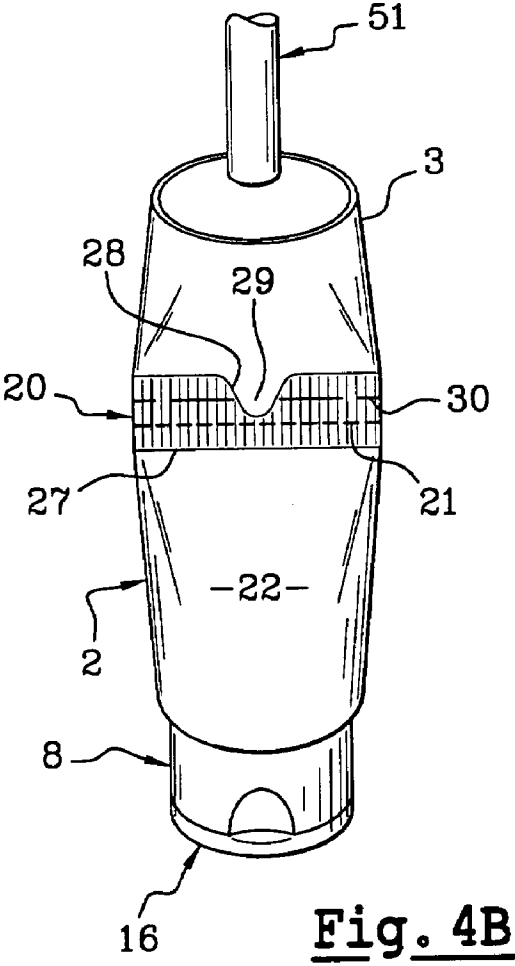
Figure 4A:
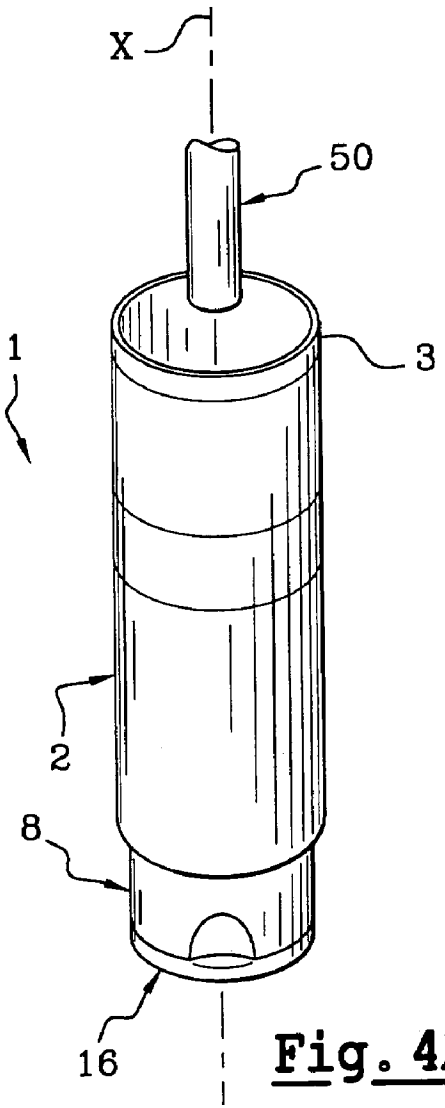

The embodiment of the tube 1, for which a filling sequence is illustrated in FIGS. 4A–4C, differs from the previous embodiment essentially in the design of the intermediate closure zone 20 separating the compartments 22 and 24. According to this embodiment, the closure zone 20 includes a straight-line edge 27 next to the compartment 22 and a non-straight edge 28 next to the compartment 24. The non-straight edge 28 is such that the compartment 24 forms a protuberance 29 substantially along the axis of the tube 1 and facing in the direction of the compartment 22.

The narrowest end of the protuberance 29 is at a non-zero distance from a pre-cut or weakened line 21, along which the two compartments 22 and 24 are intended to be separated. The protuberance 29 extends across a thinner transverse line 30, along which the weld zone 20 is to be cut or torn manually with a view toward allowing the compartment 24 to be opened. In other regards, the filling of the tube 1 according to this embodiment can be the same as that in the previous embodiment, apart from the end weld zone 23 which, in contrast to the previous embodiment, does not have a preparatory tear.

Figure 5D:
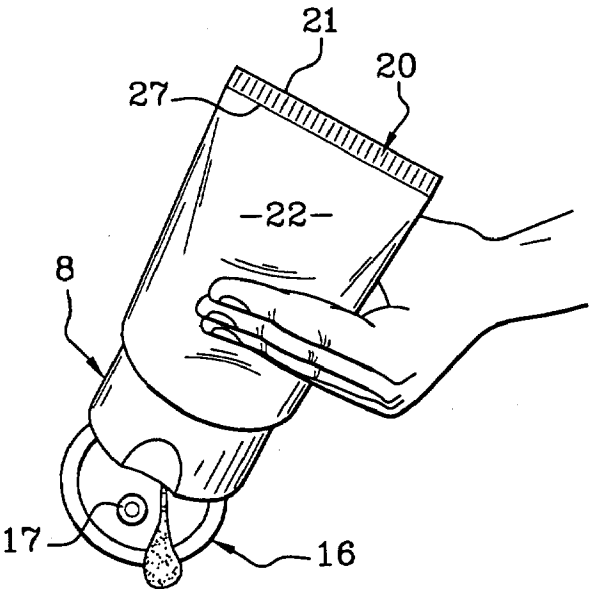
FIGS. 5A–5D illustrate the use of the tube illustrated in FIGS. 4A–4C.
Figure 5B:
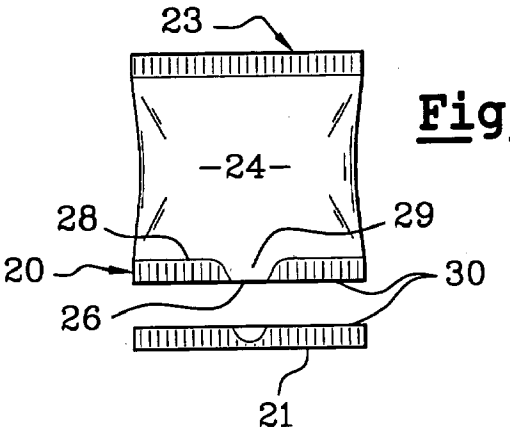
Figure 5C:
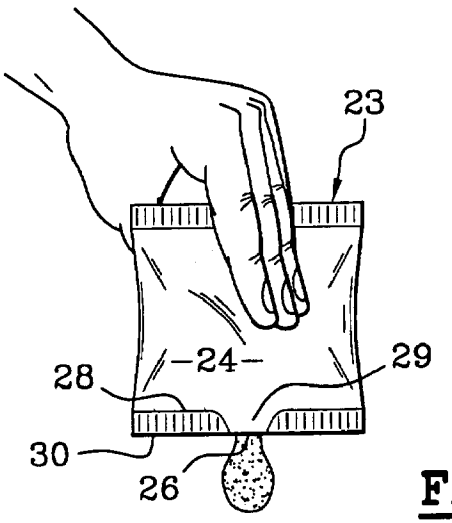
Figure 5A:
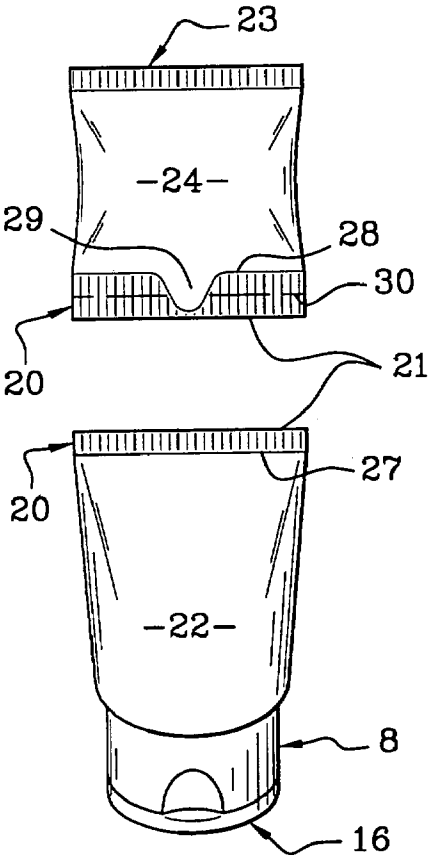

FIGS. 5A–5D, to which reference is now made, illustrate a possible sequence for use of the tube discussed with reference to FIGS. 4A–4C. In FIG. 5A, the compartment 24 is separated from the compartment 22 along the pre-cut line 21. As shown in FIG. 5B, the compartment 24 can be opened by making a cut along the weakened line 30, which crosses the non-straight edge 28 of the closure zone 20 at two points. An opening 26 is formed and extends between the two points of the edge 28. In FIG. 5C, the sample product contained in the compartment 24 can then be dispensed via the opening 26. As shown in FIG. 5D, the contents of the compartment 22 can be dispensed in the same way that a product contained in a conventional tube is dispensed. Typically, the top 16 is opened and the product emerges via the hole 15 of the cap 8 in response to pressure exerted on the deformable walls of the tube.

Obviously, numerous modifications and variations of the present invention are possible in light of the above teachings. By way of example, as discussed earlier, although the seal or weld separating the compartments can be formed between separate filling operations, particularly where the first product and the sample product are the same, one filling operation can be used, with the filling operation followed by formation of a seal or weld to separate portions of the product into two compartments. In addition, as also discussed earlier, the various weakened, cut or separation assisting lines can take various forms, for example, using a tear initiation cut or notch, using perforated or score lines, or various combinations of the foregoing. In addition, it is to be understood that the packaging and various components can have various shapes or forms. Further, as also discussed earlier, the various seals or seams (closure zones) can be formed by various expedients. It is therefore to be understood that, within the scope of the appended claims, the invention may be practiced otherwise than as specifically described herein.

What is claimed is:

1. A package comprising:

a flexible tube having an axis X, the flexible tube further including a first end having a dispensing device associated therewith, said dispensing device including a selectively openable and closable outlet hole such that the outlet hole can be opened to dispense product from said flexible tube and closed to retain product in said flexible tube, the flexible tube further including a second end opposite the first end which is closed over an end closure zone, wherein the end closure zone is formed by fastening an end edge of said flexible tube to itself, and wherein the flexible tube further includes at least one intermediate closure zone which is formed between the first and second ends at a non-zero distance from the first and second ends, and wherein the intermediate closure zone is formed by fastening a wall of said tube to itself along at least one line transverse to the said axis X so as to define at least two compartments which are isolated from one another, and wherein the at least two compartments include:

(i) a first compartment which communicates with said outlet hole of the dispensing device and which contains a first product portion, wherein the first product portion can be selectively dispensed through said outlet hole of said dispensing device when said dispensing device is in an open state, and wherein in a closed state of said dispensing device the first product portion is prevented from exiting through said outlet hole, and further wherein said dispensing device can be selectively positioned in said closed and open states; and (ii) a second compartment which is formed between said end closure zone and said intermediate closure zone, and wherein said second compartment contains a second product portion;

wherein the intermediate closure zone includes means for facilitating separation of the two compartments such that said second compartment with said second product portion therein can be separated and removed from said first compartment with said first product portion therein; and wherein the flexible tube includes a tubular body, and wherein the outlet hole is delimited by a head which is fitted onto the tubular body.

2. A package according to claim 1, wherein the means for facilitating separation breaks upon application of a manual pulling force exerted on each of the two compartments.

3. A package according to claim 1, wherein at least one of the end closure zone and the intermediate closure zone has a non-straight edge so as to make it possible to delimit a localized outlet passage for the product contained in the second compartment upon opening the second compartment.

4. A package according to claim 3, wherein said non-straight edge is formed by said intermediate closure zone and delimits a protuberance in communication with the second compartment.

5. A package according to claim 1, further including means for assisting manual opening of the second compartment.

6. A package according to claim 1, wherein the flexible tube includes a tubular body formed by extruding at least one layer including a thermoplastic material.

7. A package according to claim 6, wherein the flexible tube includes at least one of a low density polyethylene, a high density polyethylene, and a polypropylene.

8. A package according to claim 1, wherein the tubular body is formed of a plurality of layers, and wherein at least one of said plurality of layers includes a thermoplastic material.

9. A package according to claim 8, wherein said tubular body is formed by one of calendering and co-extruding a complex of said plurality of layers.

10. A package according to claim 1, wherein the first product portion and the second product portion include the same product.

11. A package according to claim 1, wherein said head is coupled to said tubular body by one of adhesive bonding and welding.

12. A package according to claim 1, wherein said head is injection molded.

13. A package according to claim 1, wherein the end closure zone and the intermediate closure zone are formed by adhesive bonding.

14. A package according to claim 1, wherein the end closure zone and the intermediate closure zone are formed by at least one of adhesive bonding and welding.

15. A package according to claim 14, wherein at least one of the end closure zone and the intermediate closure zone are formed by welding.

16. A package according to claim 15, wherein said welding includes at least one of heat welding and ultrasonic welding.

17. A package according to claim 1, wherein the dispensing device includes a closure element for selectively opening and closing said outlet hole.

18. A package according to claim 1, wherein the first product portion includes a different product than the second product portion.

19. A package according to claim 1, wherein said means for facilitating separation includes at least one of a weakened line and a pre-cut portion.

20. A package according to claim 5, wherein said means for assisting manual opening includes at least one of a cut portion and a weakened line.

21. A package according to claim 1, wherein the first product portion and the second product portion are each a cosmetic product.

22. A package as recited in claim 1, wherein said first compartment has a volume which is substantially larger than a volume of said second compartment.

23. A package according to claim 1, wherein said dispensing device has a higher rigidity than said flexible tube, and wherein said second compartment does not have a dispensing device associated therewith such that dispensing of said second product portion from said second compartment is accomplished by forming an opening in said flexible tube.

24. A package according to claim 1, wherein the means for facilitating separation is disposed such that after separation of said first compartment from said second compartment by the means for facilitating separation the second compartment remains fully closed by a portion of said intermediate closure zone at one end of said second compartment and by said end closure zone at an opposite end of said second compartment, and wherein after separation of said first compartment from said second compartment said first compartment is fully closed at one end by another portion of said intermediate closure zone and an opposite end of said first compartment is selectively openable and closable at said dispensing device.

25. A package comprising:

a flexible tube having an axis X, the flexible tube further including a first end having a dispensing device associated therewith, said dispensing device including a selectively openable and closable outlet hole such that the outlet hole can be opened to dispense product from said flexible tube and closed to retain product in said flexible tube, the flexible tube further including a second end opposite the first end which is closed over an end closure zone, wherein the end closure zone is formed by fastening an end edge of said flexible tube to itself, and wherein the flexible tube further includes at least one intermediate closure zone which is formed between the first and second ends at a non-zero distance from the first and second ends, and wherein the intermediate closure zone is formed by fastening a wall of said tube to itself along at least one line transverse to the said axis X so as to define at least two compartments which are isolated from one another, and wherein the at least two compartments include:

(i) a first compartment which communicates with said outlet hole of the dispensing device and which contains a first product portion, wherein the first product portion can be selectively dispensed through said outlet hole of said dispensing device when said dispensing device is in an open state, and wherein in a closed state of said dispensing device the first product portion is prevented from exiting through said outlet hole, and further wherein said dispensing device can be selectively positioned in said closed and open states; and (ii) a second compartment which is formed between said end closure zone and said intermediate closure zone, and wherein said second compartment contains a second product portion;

wherein the intermediate closure zone includes means for facilitating separation of the two compartments such that said second compartment with said second product portion therein can be separated and removed from said first compartment with said first product portion therein;

wherein the dispensing device includes a closure element for selectively opening and closing said outlet hole; and wherein the dispensing device includes a body which delimits said outlet hole, and wherein said closure element is one of screwed onto the body and articulated onto the body.

26. A package according to claim 25, wherein part of the dispensing device is snap-fastened to the package.

27. A package according to claim 25, wherein part of the dispensing device is screwed onto the package.

28. A package according to claim 25, wherein the closure element is articulated to the body of the dispensing device with a spring-effect hinge.

29. A package according to claim 25, wherein the means for facilitating subsequent separation includes at least one of a cut portion and a weakened line in a region of said intermediate closure zone.

30. A package including a flexible tube having a first end and a closure zone at a second end, said flexible tube further including:

a selectively openable and closable dispensing device associated with said first end, said dispensing device including an outlet opening and wherein said dispensing device can be selectively positioned in an open state in which product can exit said outlet opening and a closed state in which product is prevented from exiting said outlet opening;

an intermediate closure zone disposed between said first end and said second end;

a first compartment between said first end and said intermediate closure zone;

a second compartment between said second end and said intermediate closure zone, wherein said second compartment is isolated from said first compartment;

a first product portion disposed in said first compartment such that said first product portion is retained between said dispensing device and said intermediate closure zone;

a second product portion disposed in said second compartment such that said second product portion is retained between said intermediate closure zone and said second end;

at least one of a weakened line and a pre-cut portion in a region of said intermediate zone to facilitate separation of said first and second compartments such that the second compartment with said second product portion therein can be separated and removed from said first compartment with said first product portion therein; and further including means for assisting opening of said second compartment after said second compartment is separated from said first compartment.

31. A package according to claim 30, wherein said first product portion and said second product portion are each cosmetic products.

32. A package according to claim 31, wherein said first product portion and said second product portion are the same product.

33. A package according to claim 31, wherein the first product portion is a different product than said second product portion.

34. A package according to claim 30, wherein said dispensing device includes a head coupled to said first end of said flexible tube, wherein said head delimits said outlet opening and through which said first product portion can exit said first compartment, and wherein said dispensing device includes a body which covers a portion of said outlet opening, said body including a dispensing hole in communication with said outlet opening such that said first product portion can exit said package through said outlet opening and said dispensing hole, and wherein said body also includes a skirt which covers at least a portion of said head.

35. A package according to claim 30, wherein said second compartment includes a protrusion that forms an outlet opening for said second compartment.

36. A package as recited in claim 30, wherein said first compartment has a volume which is substantially larger than a volume of said second compartment.

37. A package according to claim 30, wherein the at least one of a weakened line and a pre-cut portion is disposed such that after separation of said first compartment from said second compartment the second compartment remains fully closed by a portion of said intermediate closure zone at one end of said second compartment and by said closure zone at an opposite end of said second compartment, and wherein after separation of said first compartment from said second compartment said first compartment is fully closed at one end by another portion of said intermediate closure zone and an opposite end of said first compartment is selectively openable and closable at said dispensing device.

38. A package including a flexible tube having a first end and a closure zone at a second end, said flexible tube further including:

a selectively openable and closable dispensing device associated with said first end, said dispensing device including an outlet opening and wherein said dispensing device can be selectively positioned in an open state in which product can exit said outlet opening and a closed state in which product is prevented from exiting said outlet opening;

an intermediate closure zone disposed between said first end and said second end;

a first compartment between said first end and said intermediate closure zone;

a second compartment between said second end and said intermediate closure zone, wherein said second compartment is isolated from said first compartment;

a first product portion disposed in said first compartment such that said first product portion is retained between said dispensing device and said intermediate closure zone;

a second product portion disposed in said second compartment such that said second product portion is retained between said intermediate closure zone and said second end;

at least one of a weakened line and a pre-cut portion in a region of said intermediate zone to facilitate separation of said first and second compartments such that the second compartment with said second product portion therein can be separated and removed from said first compartment with said first product portion therein;

wherein said second compartment includes a protrusion that forms an outlet opening for said second compartment; and upon separation of said first and second compartments a first portion of said intermediate closure zone is retained with said first compartment and a second portion of said intermediate closure zone is retained with said second compartment, and wherein said protrusion extends into said second portion of said intermediate zone, and further wherein means for separating part of said second portion of said intermediate zone from said second compartment are provided such that, upon separation of said part of said second portion of said intermediate zone, the outlet opening for said second compartment is opened through said protrusion.

39. A package comprising:

a flexible tube having an axis X, the flexible tube further including a first end having a dispensing device associated therewith, said dispensing device including a selectively openable and closable outlet hole such that the outlet hole can be opened to dispense product from said flexible tube and closed to retain product in said flexible tube, the flexible tube further including a second end opposite the first end which is closed over an end closure zone, wherein the end closure zone is formed by fastening an end edge of said flexible tube to itself, and wherein the flexible tube further includes at least one intermediate closure zone which is formed between the first and second ends at a non-zero distance from the first and second ends, and wherein the intermediate closure zone is formed by fastening a wall of said tube to itself along at least one line transverse to the said axis X so as to define at least two compartments which are isolated from one another, and wherein the at least two compartments include:

(i) a first compartment which communicates with said outlet hole of the dispensing device and which contains a first product portion, wherein the first product portion can be selectively dispensed through said outlet hole of said dispensing device when said dispensing device is in an open state, and wherein in a closed state of said dispensing device the first product portion is prevented from exiting through said outlet hole, and further wherein said dispensing device can be selectively positioned in said closed and open states; and (ii) a second compartment which is formed between said end closure zone and said intermediate closure zone, and wherein said second compartment contains a second product portion;

wherein the intermediate closure zone includes means for facilitating separation of the two compartments such that said second compartment with said second product portion therein can be separated and removed from said first compartment with said first product portion therein; and wherein said dispensing device includes a cap to selectively open and close said outlet hole.

40. A package including a flexible tube having a first end and a closure zone at a second end, said flexible tube further including:

a selectively openable and closable dispensing device associated with said first end, said dispensing device including an outlet opening and wherein said dispensing device can be selectively positioned in an open state in which product can exit said outlet opening and a closed state in which product is prevented from exiting said outlet opening;

an intermediate closure zone disposed between said first end and said second end;

a first compartment between said first end and said intermediate closure zone;

a second compartment between said second end and said intermediate closure zone, wherein said second compartment is isolated from said first compartment;

a first product portion disposed in said first compartment such that said first product portion is retained between said dispensing device and said intermediate closure zone;

a second product portion disposed in said second compartment such that said second product portion is retained between said intermediate closure zone and said second end;

at least one of a weakened line and a pre-cut portion in a region of said intermediate zone to facilitate separation of said first and second compartments such that the second compartment with said second product portion therein can be separated and removed from said first compartment with said first product portion therein; and wherein said dispensing device has a higher rigidity than said flexible tube, and wherein said second compartment does not have a dispensing device associated therewith such that dispensing of said second product portion from said second compartment is accomplished by forming an aperture in said flexible tube.

* * * * *